US005361614A

United States Patent [19]

Metcalf

[11] Patent Number: 5,361,614

[45] Date of Patent: Nov. 8, 1994

[54] PIN-TUMBLER LOCK WITH RETAINED KEY AND METHOD OF OPERATION THEREOF

[75] Inventor: Jeff W. Metcalf, Kitchener, Canada

[73] Assignees: Steven Elvy, Kitchener; Al Culshaw, Waterloo, both of Canada

[21] Appl. No.: 45,774

[22] Filed: Apr. 14, 1993

[51] Int. Cl.[5] ..... E05B 11/00

[52] U.S. Cl. ..... 70/389; 70/419

[58] Field of Search ..... 70/372, 379 R, 380, 70/386, 389, 419, DIG. 42, DIG. 60

[56] References Cited

U.S. PATENT DOCUMENTS

| | | | |
|---|---|---|---|
| 3,575,024 | 4/1971 | Schlage | 70/389 |
| 3,633,394 | 1/1972 | Pieck | 70/389 |
| 3,729,964 | 5/1973 | Hsu | 70/389 X |
| 4,120,184 | 10/1978 | Gerlach | 70/389 |
| 4,228,669 | 10/1980 | Bischoff | 70/389 X |
| 4,300,374 | 11/1981 | Mullich et al. | 70/379 R X |
| 4,315,420 | 2/1982 | Oliver | 70/389 X |
| 4,369,642 | 1/1983 | Grell | 70/389 |
| 4,376,381 | 3/1983 | Muus | 70/389 X |
| 4,631,941 | 12/1986 | Sjunnesson | 70/389 X |

FOREIGN PATENT DOCUMENTS

| | | | |
|---|---|---|---|
| 2057570 | 6/1971 | Germany | 70/389 |

*Primary Examiner*—Peter M. Cuomo
*Assistant Examiner*—Suzanne L. Dino
*Attorney, Agent, or Firm*—Daryl W. Schnurr

[57] ABSTRACT

A pin-tumbler lock and method of use thereof has an inside cylinder and conventional outside cylinder. The inside cylinder operates with a pin-tumbler key but cannot be operated by the key that operates the outside cylinder. The pin-tumbler key is retained automatically in the inside cylinder once inserted but can be manually released by using an appropriate tool. The inside cylinder retains the pin-tumbler key because the pins become misaligned when the pin-tumbler key is inserted. Previous locks can be a fire hazard or can be burglarized too easily.

12 Claims, 3 Drawing Sheets

PIN-TUMBLER LOCK WITH RETAINED KEY AND METHOD OF OPERATION THEREOF

BACKGROUND OF THE INVENTION

1. Field of the Invention

This invention relates to a key operated pin-tumbler lock where a thumb turn key can be retained in the lock and a method of operation therefor. More particularly, this invention relates to a key operated pin-tumbler lock where the thumb turn key can be automatically retained in the lock when inserted and removed by using manually operated release means.

2. Description of the Prior Art

Pin-tumbler locks with thumb turns on the inner side are known. These locks can be a security problem in that the lock can easily be opened from the inside by breaking a window in the door or near the door to provide access to the thumb turn. Pin-tumbler locks that must be opened or locked with a key both inside and outside are also known. These locks can present a problem from a safety point of view in that they can prevent a quick exit in the event of a fire or other emergency. If the lock is locked from the inside but the inside key has been removed, obviously, the door cannot be opened until the key is located. The advantage of this lock is that a burglar who has access to the inside of the lock still is unable to open it without the key.

Pin-tumbler locks having thumb turn keys that are retained on the inside but still removable by taking an additional step, are also known. The Gerlach U.S. Pat. No. 4,120,184 issued on Oct. 17th, 1978 describes a pin-tumbler type of lock having a special abutment portion on the key which prevents removal of the key from the lock cylinder unless a special removal instrument is inserted into the lock cylinder adjacent to the key to release the locking pin from the abutment and permit the removal of the key. The U.S. Oliver U.S. Pat. No. 4,315,420 was issued on Feb. 16th, 1982 and describes a double cylinder lock deadbolt which has a key thumb turn for use with the inside cylinder and a standard key for use with the outside cylinder. When the inside key has been inserted, it triggers a spring-mounted lever which retains the key in the inside cylinder until the outside key is inserted into the outside cylinder and turned to release the inside key from the lever. Previous systems for retaining or allowing a key to be removed from a locking cylinder are either too complex; too expensive; or the manner in which the key is made removable is disadvantageous; or the design does not permit sufficient variations to thwart would be burglars. For example, with the lock described in the Gerlach patent, the key can only be removed through the use of a special removal device. Also, when the inside key is inserted in the locking cylinder and the lock is in a locked position, the lock cannot be opened from the outside using the appropriate key. Also, burglars who are familiar with the Gerlach lock could carry the removal device with them. With the Oliver patent, if one is inside the premises and wishes to remove the inside key from the locking cylinder, one must find the outside key, open the door, insert the outside key in the outside locking cylinder and turn the outside key before the inside key will be removable.

SUMMARY OF THE INVENTION

It is an object of the present invention to provide a key operated pin-tumbler lock where a thumb turn key, when it is inserted from the inside, can be simply and effectively retained in the locking cylinder until it is desired to remove the thumb turn key. It is further an object of the present invention to provide a key operated pin-tumbler lock where the thumb turn key, once it has been retained in the locking cylinder, can be readily removable in a variety of different ways with simple design changes.

A key operated pin-tumbler lock has a pin-tumbler locking cylinder and a thumb turn key. The locking cylinder has a cylinder plug located within a cylinder housing, said cylinder plug having a first set of openings and a first set of pins with a pin slidably mounted in each opening. The cylinder housing has a second set of openings and a second set of pins with a pin being spring-mounted in each opening. The second set of pins is urged towards said cylinder plug, said first set of openings and pins corresponding to said second set of openings and pins so that the corresponding openings and pins are aligned with one another in a first position. The cylinder plug contains a keyway for receiving the thumb turn key. There are means for automatically preventing said thumb turn key from being removed upon insertion by misaligning at least one pin in said first set of openings with a corresponding pin in said second set of openings so that said pins that are misaligned with one another are no longer slidable in said openings in which they are located, thereby trapping said key in said keyway as soon as said key has been inserted and before said key is turned. The misaligned pins are in a second position. There are manually operated release means located entirely externally of said locking cylinder for returning said locking cylinder to said first position, thereby permitting said key to be removed.

DESCRIPTION OF A PREFERRED EMBODIMENT

Figure 1:
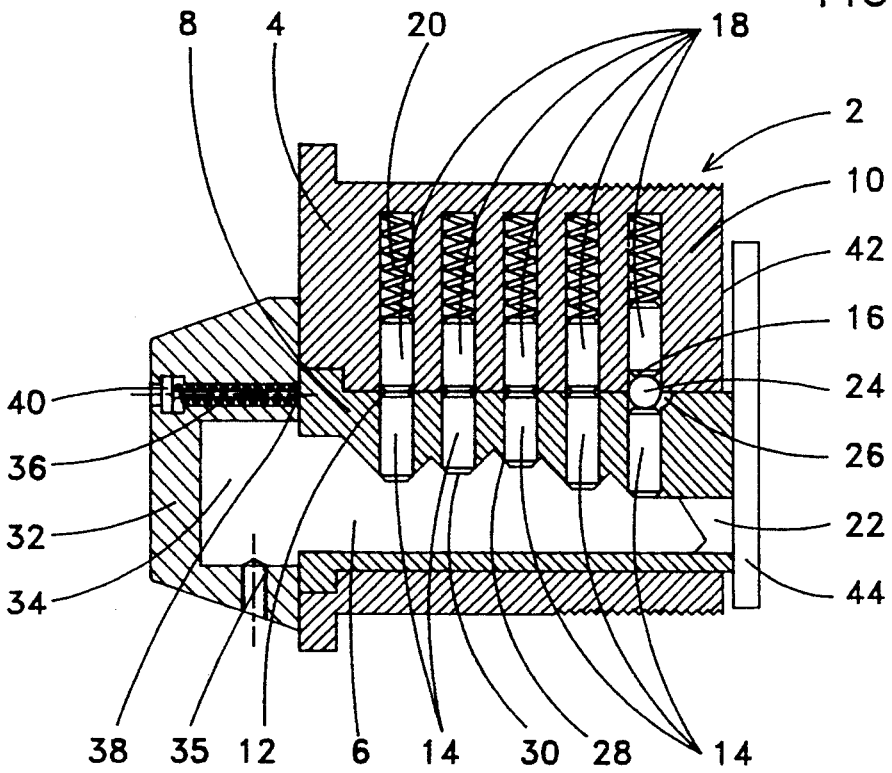
FIG. 1 is a partial sectional side view of a key operated pin-tumbler lock with all of the pins in alignment.

Referring to FIG. 1 in greater detail, a pin-tumbler lock 2 has a pin-tumbler locking cylinder 4 and a thumb turn key 6. The locking cylinder 4 has a cylinder plug 8 located within a cylinder housing 10. The cylinder plug has a first set of openings 12 and a first set of pins 14. The cylinder housing 10 has a second set of openings 16 and a second set of pins 18. The second set of pins 18 are spring-mounted and urge toward the cylinder plug 8 by springs 20. The first set of openings 12 and pins 14 correspond to the second set of openings 16 and pins 18. The corresponding openings 12, 16 and pins 14, 18 are aligned with one another in a first position as shown in FIG. 1. The cylinder plug 8 contains a keyway 22 for receiving the thumb turn key 6. There are means 24 for automatically misaligning at least one pin 14 in said first set of openings 12 with a corresponding pin 18 in said second set of openings 16 so that the pins that are misaligned with one another are no longer slidable in said openings in which they are located, thereby trapping the key 6 in the keyway 22.

Figure 2:
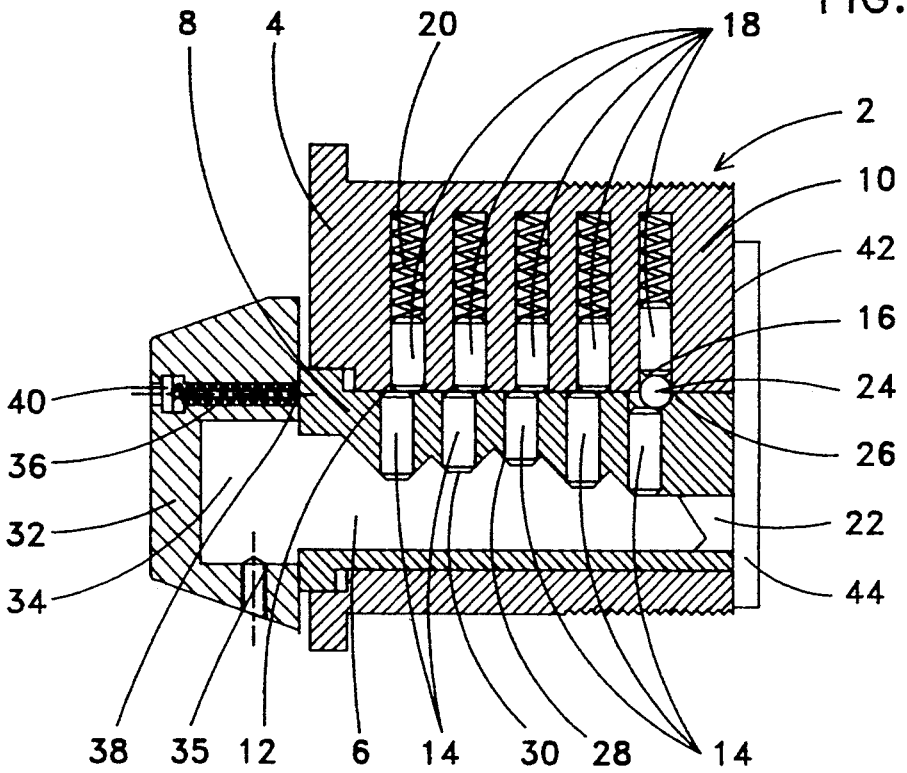
FIG. 2 is a partial sectional side view of the lock of FIG. 1 with all of the pins misaligned.

In FIG. 2, all of the pins of the first set are misaligned with all of the pins of the second set. A pin in the first set of pins can be misaligned with a corresponding pin in the second set of pins in various ways. In FIG. 1, the misalignment means 24 is a ball bearing located between the two innermost pins 14, 18. The ball bearing is located in an extended seat 26 to assist in misaligning the two innermost pins. Thus, the opening closest to an interior end of said cylinder plug 8 is enlarged in a direction parallel to the direction of insertion or removal of said key by the extended seat 26 so that a pin in said opening can slip into position when an appropriate force is exerted on said pin to become misaligned relative to a corresponding pin in said cylinder housing 10. When the pins are misaligned, they are no longer slidable longitudinally within the opening in which they are located. Since the misaligned pins are no longer slidable, if a ridge on a key is located towards the inside of misaligned pins, the key cannot be removed until the pins are again made slidable.

FIG. 2 shows the lock in a second position with the entire cylinder plug moved slightly relative to the cylinder housing so that all of the pins 14 in the first set of openings 12 are misaligned with all of the pins 18 in the second set of openings 16. It should be noted that the length of the first set of pins relative to the second set of pins must be controlled or varied to correspond with ridges 28 and valleys 30 on the thumb turn key 6 being used in the lock so that when the key is inserted, a line of contact between the two sets of pins corresponds with a line of contact between the cylinder plug and the cylinder housing. With the ball bearing 24 being located between the two innermost pins, more leeway is permitted in the design length of the pins as the pins will misalign when the thumb turn key 6 is inserted as long as the ball bearing lies somewhere along the line of contact between the cylinder plug and the cylinder housing. The key 6 has a thumb turn 32 mounted on its head 34. The thumb turn 32 contains manually operated release means. The thumb turn 32 is held onto the head 34 of the thumb turn key 6 by a set screw 35.

Figure 3:
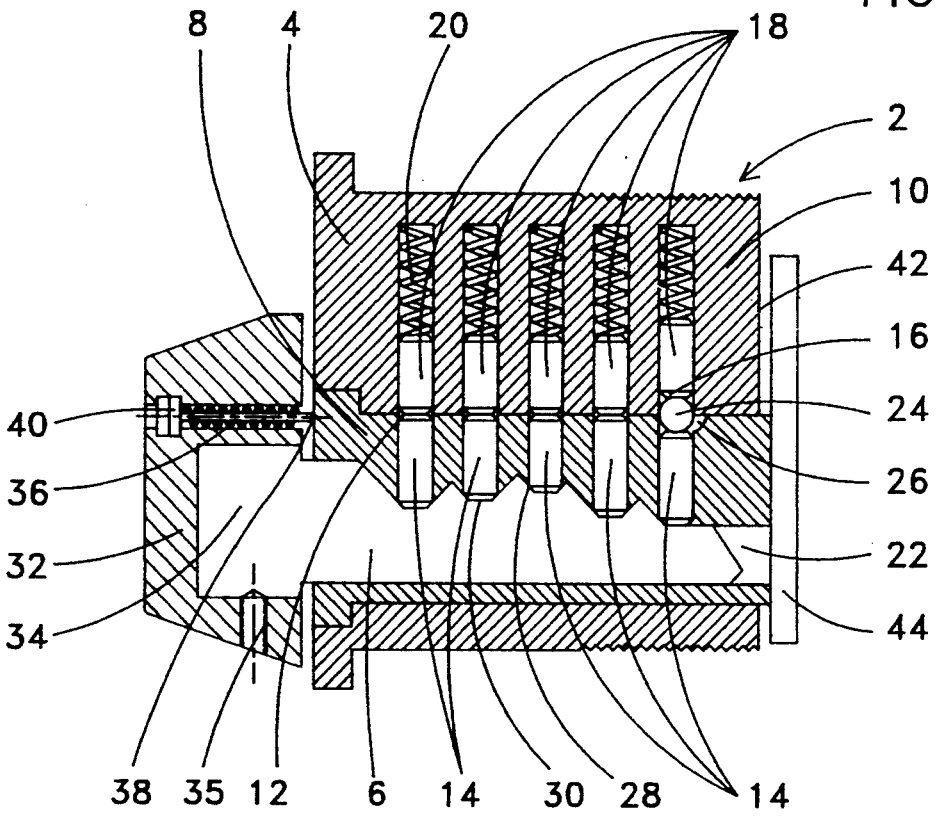
FIG. 3 is a partial sectional side view of the lock of FIG. 2 with all of the pins realigned by use of release means.

In FIGS. 1, 2 and 3, the manually operated release means is a threaded screw 36 mounted into the thumb turn 32 so that an inner end 38 of the screw 36 abuts the cylinder plug 8. When the screw is turned so that it advances inward, the end 38 of the screw 36 pushes the cylinder plug 8 inward relative to the thumb turn 32 returning the pins 14, 18 into a state of alignment as shown in FIG. 3. The screw 36 has a head 40 and the head is designed so that it can be turned with a common tool such as a flathead screwdriver or, more preferably, a specific tool having a peculiar shape so that tools used to turn the screw are not widely distributed or available. For example, the head could contain an indentation in the shape of a star or an "s" or any reasonably shaped letter of the alphabet or a shape 41 as shown for the head 40 in FIG. 5. Other means of moving the cylinder plug inward relative to the thumb turn 32 can be utilized. Though not preferred, a lever could be mounted on the thumb turn so that when the lever is depressed, the cylinder plug is forced inward relative to the thumb turn.

On an interior end 42 of the locking cylinder 4, there is located a stepped cam 44. As can be seen by comparing FIGS. 1, 2 and 3, the stepped cam assists the misalignment by permitting the cylinder plug 8 to be misaligned with the cylinder housing 10. If the cam 44 were not stepped and were entirely flat, no misalignment would occur between the plug and the housing.

Figure 4:
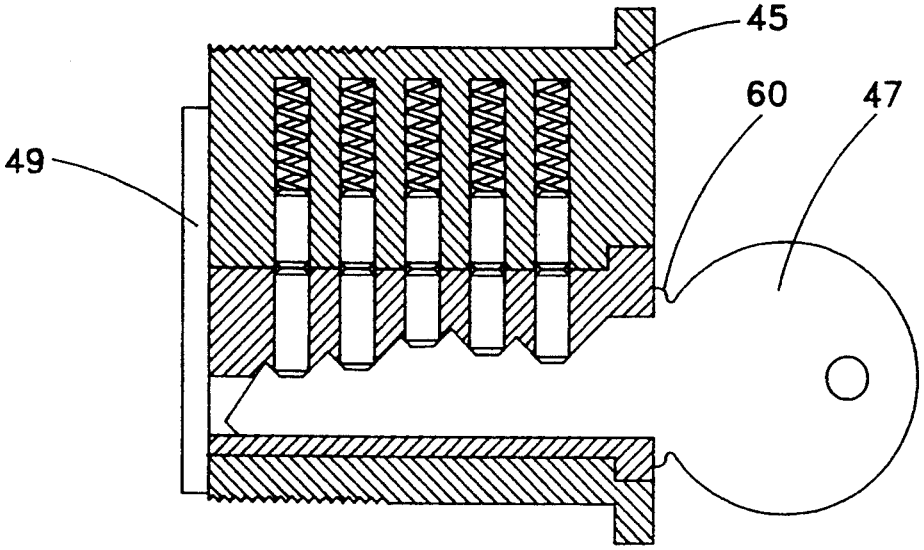
FIG. 4 is a partial sectional side view of a conventional locking cylinder to be used as an outside cylinder.

In FIG. 4, an outside cylinder 45 has a key 47, which is not usable in the locking cylinder 4, but only locks or opens the cylinder 45. A cam 49 is conventional (i.e. is not a stepped cam) as is the cylinder 45. The cylinder 45 is designed to be mounted adjacent to the lock 2 with the cam 44 immediately adjacent to the cam 49.

Figure 5:
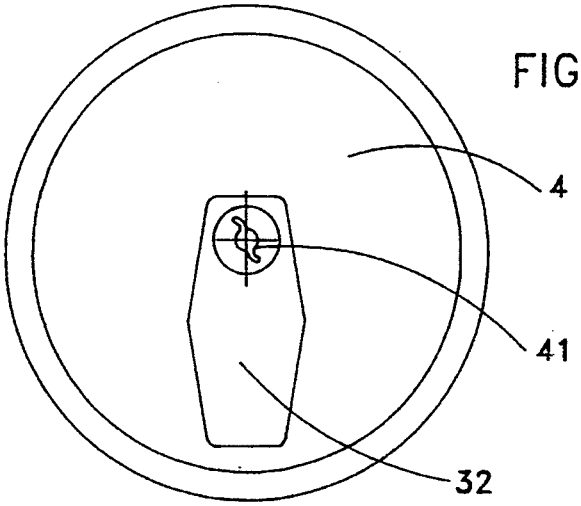
FIG. 5 is an end view of the lock of FIG. 1 from a thumb turn end.
Figure 9:
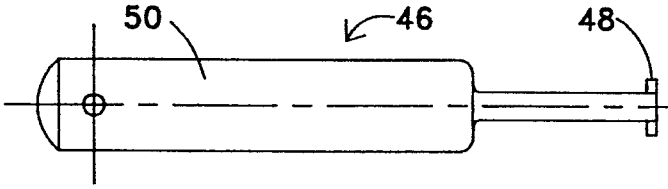
FIG. 9 is a front view of a tool to operate the manual release means.

In FIG. 5, there is shown a front view of the locking cylinder 4 when viewed from the inside of a door (not shown). It can be seen that the thumb turn 32 has an opening therein that permits access to the head 40 (not shown) of the screw 36 (not shown). The head 40 has an indentation 41 therein that has a peculiar shape. In order to turn the screw 36, one requires a tool that is shaped to fit snugly within the indentation 41. A front view of a tool 46 is shown in FIG. 9. The tool 46 has an end 48 which would have a shape corresponding to the shape of the indentation on the head 40 of the screw 36. There are various shapes that would be suitable. The tool 46 has a handle 50.

Figure 6:
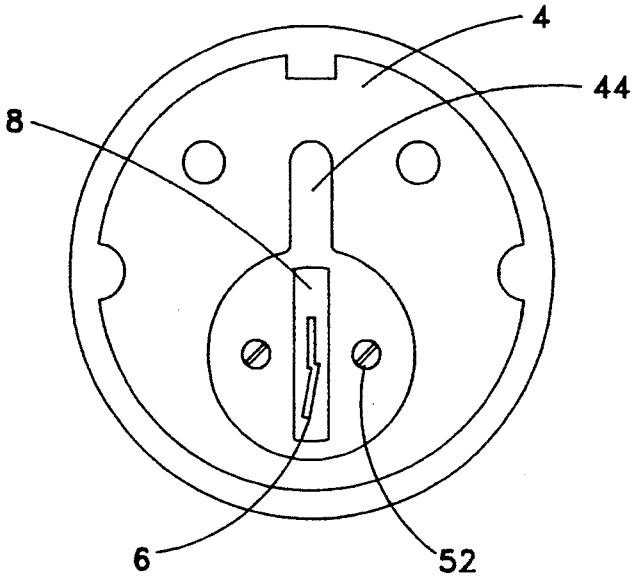
FIG. 6 is an end view of the lock of FIG. 1, an end opposite to the thumb turn.
Figure 7:
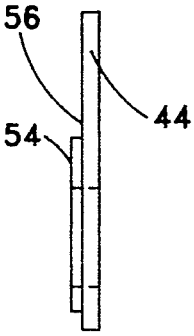
FIG. 7 is a side view of a cam.
Figure 8:
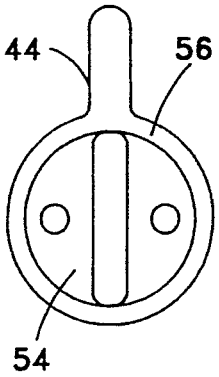
FIG. 8 is a front view of the cam.

In FIG. 6, there is shown a rear view of the cylinder lock 4 and the cam 44. With the thumb turn key 6 located in the keyway 22, the cam 44 is held in place by two screws 52. As can be seen from FIGS. 7 and 8, the cam 44 is a stepped cam in that a portion 54 located on an inner surface 56 is raised relative to the surface 56. The portion 54 corresponds to that part of the cam that is adjacent to the cylinder plug 8 as can be seen from FIGS. 1 and 3.

Figure 10:
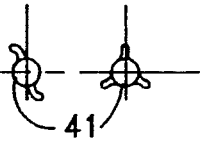
FIG. 10 is a front view of two distinct shapes for a head of the tool.

In FIG. 10, there is shown a front view of two different shapes 41 for the head 40 of the screw 36. The head 48 of the tool 46 would have a corresponding head.

The locking system of the present invention has an exterior key 47 that is different from the thumb turn key 6 so that the exterior key will not operate the locking cylinder 4 but will only operate the outside cylinder 45. The key 47 could be designed with a shoulder 60 on it so that it cannot be fully inserted into the keyway 22. The system is designed so that when the residence is unoccupied the thumb turn key 6 will be removed from the inside cylinder. When the residence is occupied the thumb turn key will be retained in the inside cylinder so that occupants can quickly exit the premises in an emergency. Usually, it is unoccupied premises that are burglarized. It should be noted that the pin 14 of the first set that is located in the innermost position adjacent to the ball bearing is shorter than it would otherwise be if the ball bearing was eliminated. This pin is short so that the ball bearing will seat partially within the opening 12 in which this pin is located. The ball bearing assists in centering the pin 14 when the pins are realigned.

The locking cylinder 4 is the inside locking cylinder and the lock preferably has a second locking cylinder 45 that is an outside locking cylinder. The lock is preferably designed so that the thumb turn key 6 will not operate the second locking cylinder.

What we claim as our invention is:

1. A key operated pin-tumbler lock comprising a pin-tumbler locking cylinder and a thumb turn key said locking cylinder having a cylinder plug located within a cylinder housing, said cylinder plug having a first set of openings and a first set of pins with a pin slidably mounted in each opening, said cylinder housing having a second set of openings and a second set of pins, with a pin being spring-mounted in each opening, said second set of pins being urged toward said cylinder plug, said first set of openings and pins corresponding to said second set of openings and pins so that said corresponding openings and pins are aligned with one another in a first position, said cylinder plug containing a keyway for receiving a said thumb turn key, with means for automatically preventing said thumb turn key from being removed upon insertion by misaligning at least one pin in said first set of openings with a corresponding pin in said second set of openings so that said pins are misaligned with one another are no longer slidable in said openings in which they are located, thereby trapping said thumb turn key in said keyway as soon as said key has been inserted and before said key is turned, said misaligned pins being in a second position, manually operated release means located entirely externally of said locking cylinder for returning said locking cylinder to said first position, thereby permitting said thumb turn key to be removed.

2. A lock as claimed in claim 1 wherein the pins located closest to an interior end of the locking cylinder are the at least one pins that can be misaligned.

3. A lock as claimed in claim 2 wherein the opening closest to the interior end of said cylinder plug is enlarged in a direction parallel to the direction of insertion or removal of said key so that a pin in said opening can slip out of position when an appropriate force is exerted on said pin to become misaligned relative to a corresponding pin in said cylinder housing.

4. A lock as claimed in claim 1 wherein the means for automatically preventing the thumb turn key from being removed upon insertion by misaligning said at least one pin is a stepped cam, which causes all of the first set of pins to become misaligned with all of the second set of pins.

5. A lock as claimed in any one of claims 1, 2 or 3 wherein one pin of the first set and a corresponding pin of the second set that can be misaligned are separated by a ball bearing, the ball bearing being seated loosely to assist in the misalignment and realignment of said pins that are separated by the ball bearing.

6. A lock as claimed in any one of claims 1, 2 or 3 wherein a thumb turn is mounted on a head of the thumb turn key.

7. A lock as claimed in any one of claims 1, 2 or 3 wherein the release means, when activated, forces the cylinder plug inward relative to said key and said cylinder housing.

8. A lock as claimed in claim 1 wherein the thumb turn key has a thumb turn mounted on a head thereof and there is a screw inserted into a suitable threaded opening in the thumb turn, said screw abutting an exterior surface of the cylinder plug to force it inward relative to the key and cylinder housing when the screw is turned inward, thereby realigning any misaligned pin-tumblers.

9. A lock as claimed in claim 8 wherein the screw has a head that is enclosed in a cover having an appropriate opening of a particular shape, said opening being shaped to receive a tool of the same shape, said tool being insertable into said opening into contact with the head of said screw so that the screw can be turned inward or outward through the use of the tool, as desired, the screw being inaccessible when the tool is unavailable.

10. A lock as claimed in claim 2 wherein the lock has a second locking cylinder that is an outside locking cylinder.

11. A lock as claimed in claim 10 wherein the key to the locking cylinder will not operate the second locking cylinder.

12. A method of removably retaining the key in a rotatable cylinder pin-tumbler lock through controlled misalignment of at least one pin-tumbler, said lock having a pin-tumbler locking cylinder having a plurality of pins, each pin being spring-mounted within an opening to extend into the locking cylinder, said pins being actionable longitudinally when an appropriate key is inserted to open or lock the lock, there being control means for automatically preventing said key from being removed upon insertion by misaligning the at least one of the pin-tumblers when a key is inserted, thereby retaining the key in the lock and preventing its removal, with manually operated release means located externally of the locking cylinder for realigning said previously misaligned pin-tumblers, thereby permitting said key to be removed, said method comprising the steps of arranging the locking cylinder so that at least one of the pin-tumblers will become automatically misaligned when a key is inserted therein, inserting a key in said locking cylinder, using the lock as desired, activating the release means to remove the key from the locking cylinder.

* * * * *